United States Patent [19]

Lovelace et al.

[11] Patent Number: 4,573,412

[45] Date of Patent: Mar. 4, 1986

[54] PLUG NOZZLE KINETIC ENERGY PENETRATOR ROCKET

[75] Inventors: Donald E. Lovelace; Michael C. Schexnayder; George W. Snyder, all of Huntsville, Ala.

[73] Assignee: The United States of America as represented by the Secretary of the Army, Washington, D.C.

[21] Appl. No.: 604,772

[22] Filed: Apr. 27, 1984

[51] Int. Cl.[4] ..... F42B 15/10; F42B 11/00

[52] U.S. Cl. ..... 102/374; 102/517; 244/3.23

[58] Field of Search ..... 102/374, 376, 517-518; 60/909; 244/3.23

[56] References Cited

U.S. PATENT DOCUMENTS

| | | | |
|---|---|---|---|
| 2,989,922 | 6/1961 | Greenwood et al. | 244/3.23 |
| 3,277,825 | 10/1966 | Marllard | 102/518 |
| 3,416,944 | 12/1968 | Pirrung et al. | 60/909 |
| 3,754,507 | 8/1973 | Dillinger et al. | 102/518 |
| 3,964,696 | 6/1976 | Orzechowski et al. | 244/3.23 |
| 4,397,240 | 8/1983 | Rottenberg et al. | 102/376 |

*Primary Examiner*—Harold J. Tudor

*Attorney, Agent, or Firm*—Anthony Thomas Lane; Robert P. Gibson; Harold W. Hilton

[57] ABSTRACT

A kinetic energy penetrator having a penetrator rod which is placed inside a rocket propelled motor casing to become the major load carrying member of the airframe structure.

4 Claims, 1 Drawing Figure

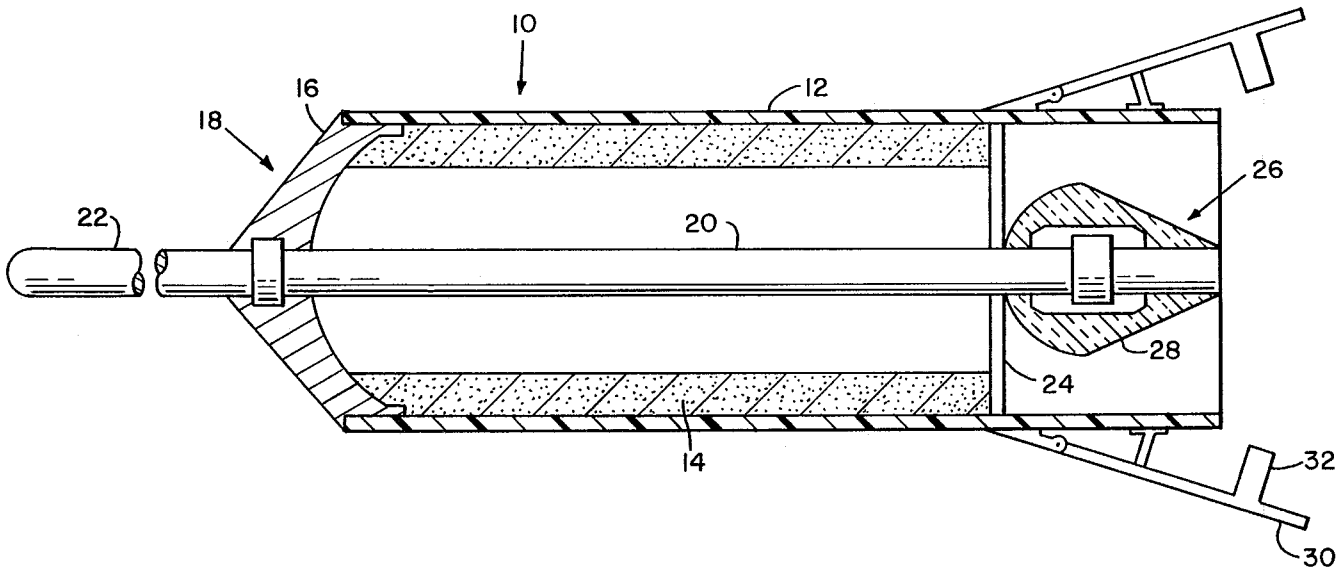
10
12
14
16
18
20
22
24
26
28
30
32

PLUG NOZZLE KINETIC ENERGY PENETRATOR ROCKET

DEDICATORY CLAUSE

The invention described herein may be manufactured, used, and licensed by or for the Government for governmental puroses without the payment to us of any royalties thereon.

BACKGROUND OF THE INVENTION

Historically kinetic energy penetrators have been fired from tank guns where the launch accelerations are in the magnitude of 50,000 g's. A penetrator diameter of approximately one inch is required to withstand these high launch accelerations; however, the diameter does not contribute to armor penetration as penetration is primarily dependent upon penetrator length. Therefore, the most weight efficient kinetic energy penetrator is one of required length to penetrate a given target and of minimum diameter. In order to decrease the diameter to a minimum the launch accelerations must be reduced, which can be achieved by reducing total weight and by utilizing a kinetic energy penetrator rocket system. Since the penetrator weight is proportional to the square of the diameter a one-half inch diameter penetrator will decrease the total penetrator weight by a factor of four of a one-inch penetrator. The reduction in penetrator diameter and weight allows for the use of a rocket with lower launch accelerations than those of guns, yet maintaining the length of the present one-inch diameter penetrator. This invention uses a plug nozzle and a weight efficient structure which contributes to reducing total weight and launch level acceleration requirements. The plug nozzle kinetic energy penetrator rocket described in the present invention can be used as an unguided weapon or as a kinetic energy penetrator test vehicle.

SUMMARY OF THE INVENTION

A plug nozzle kinetic penetrator having the penetrator rod extending axially through the airframe structure. The airframe structure includes a rocket motor having a head closure secured to the forward end of the penetrator rod and steel struts secured to the aft end of the penetrator rod. A plug nozzle assembly is provided at the aft end of the penetrator rod.

BRIEF DESCRIPTION OF THE DRAWING

The FIGURE is an elevational sectional view of the kinetic penetrator assembly of the present invention.

DESCRIPTION OF THE PREFERRED EMBODIMENT

As seen in the FIGURE, the plug nozzle kinetic energy penetrator rocket 10 includes a rocket motor 12 having a propellant 14 therein. The motor is a fiberglass case and an aluminum head closure member 16 is secured to the forward end 18 thereof. Penetrator rod 20 includes a tip portion 22 extending through closure member 16. A plurality of steel struts 24 is secured to motor casing 12 and to the aft end 26 of rod 20. A phenolic build-up 28 is disposed on aft end 26 of rod 24 to form a plug nozzle with motor casing 12. The phenolic 28 forms an insulator around the aft end of rod 28 to prevent erosion of the rod at this point. A plurality of fins 30 having angled spin tabs 32 thereon is mounted on the aft end of motor casing 12.

The operation cycle of the plug nozle, kinetic energy penetrator begins when an igniter pad (not shown) ignites propellant 14. The burning propellant produces gases which exit the rocket by passing through the nozzle formed by rod 20 and the fiberglass case 12. These gases impinge on the spin tabs 32 which are on fins 30. While the rocket is in the launch tube the fins are held down against the fiberglass case. The fins are biased outwardly, in conventional manner, when the rocket exits the launch tube. The spin tabs are angled relative to the gas flow and causes the rocket to spin. The propellant continues to burn until the rocket reaches design velocity of approximately 1500 meters per second. Upon striking the target, the impact forces separate the penetrator from the aluminum head closure 16, case 12, struts 24, and fins 30. The penetrator then drives into the target through a combination of penetrator erosion and target material flow (hydrodynamic penetration).

It will be noted that the penetrator rod carries the major structural load in the axial direction. This permits a light weight, fiber composite case to contain the motor pressure, resulting in a more weight efficient structure. Also the placing of the penetrator inside the motor permits the shortest rocket length possible. Additionally, the placing of the tungsten penetrator inside the motor takes advantge of the fact that the elongation of pure tungsten increases by several hundred percent as temperature increases. The high length to diameter ratio of the penetrator rod is a more weight efficient penetrator than the short length to diameter rods used in gun launched projectiles. Also, the acceleration of the vehicle is an order of magnitude lower than gun accelerations, permitting material properties needed for penetration to be optimized.

We claim:

1. A plug nozzle kinetic penetrator rocket comprising:

a. a rocket motor casing having a forward closure member secured thereto;

b. a kinetic energy penetrator rod having a forward end supported by and extending through said closure member;

c. a plurality of struts secured in spaced relation to an aft end of said penetrator rod for supporting said penetrator rod along the longitudinal axis of acid rod; and d. insulating means disposed around the aft end of said penetrator rod to prevent erosion thereof said insulating means forming a plug nozzle with said motor casing. pg,7

2. Apparatus as in claim 1 including a plurality of fins carried around the aft end of said casing, said fins extending outwardly responsive to said motor exiting a launch tube.

3. Apparatus as in claim 2 wherein said fins are provided with angled spin tabs thereon for impingement of rocket exhaust gases thereon while said rocket is in the launch tube.

4. Apparatus as in claim 3 wherein said insulating material is phenolic.

* * * * *